US006337535B1

(12) United States Patent
Kim

(10) Patent No.: US 6,337,535 B1
(45) Date of Patent: Jan. 8, 2002

(54) PANEL IN CATHODE RAY TUBE

(75) Inventor: Yong Kun Kim, Pusan-Kwangyok-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/426,775

(22) Filed: Oct. 26, 1999

(51) Int. Cl.[7] ..... H01J 31/00; H01J 29/00

(52) U.S. Cl. ..... 313/461; 313/477 R; 313/463; 313/466; 313/469; 220/2.1 A; 220/2.1 R; 220/2.3 A; 220/2.3 R

(58) Field of Search ..... 313/461, 477 R, 313/463, 466, 469, 364; 220/2.1 A, 2.1 R, 2.3 A, 2.3 R

(56) References Cited

U.S. PATENT DOCUMENTS 5,814,933 A * 9/1998 Iwata et al. ..... 313/477 R
6,133,681 A * 10/2000 Nakamura et al. ..... 313/402
6,133,686 A * 10/2000 Inoue et al. ..... 313/477 R
6,160,344 A * 12/2000 Cho et al. ..... 313/477 R

FOREIGN PATENT DOCUMENTS

JP 354097360 * 8/1979 ..... H01J/29/07

* cited by examiner

*Primary Examiner*—Nimeshkumar D. Patel
*Assistant Examiner*—Sikha Roy

(57) ABSTRACT

Panel in a cathode ray tube having a flat outside and a curved inside surfaces, which can provide a perfect flat image at an appropriate distance of view, wherein a condition of $2.48\times10^6(mm^2)\leqq R\times CFT\leqq 4.38\times10^6(mm^2)$ is set for the CRT for use as a TV receiver, and a condition of $2.17\times10^5(mm^2)\leqq R\times CFT\leqq 6.93\times10^5(mm^2)$ is set for the CRT for use as a monitor, where R is a curvature represented by at least one of vertical, horizontal and diagonal curvatures of the inside surface of the panel and CFT is a center thickness of the panel.

4 Claims, 6 Drawing Sheets

PANEL IN CATHODE RAY TUBE

BACKGROUND OF THE INVENTION

1. Field of the Invention

The present invention relates to a cathode ray tube, and more particularly, to a panel in a cathode ray tube for displaying an image outside of the cathode ray tube.

2. Background of the Related Art

FIG. 1 illustrates a side view of a related art cathode ray tube with a partial section, provided with a fluorescent film 2 having red, green and blue fluorescent material coated on an inside of a panel 1, and a funnel 3 glass welded to rear of the panel 1 having an electron gun (not shown) sealed in a neck portion 3*a* thereof. There is a shadow mask 5 adjacent to the fluorescent film 2 coated inside of the panel 1 for selection of a color of electron beams 4 emitted from the electron gun fixed to a frame 6, which is held hung from the panel 1, with a spring 7 fixed to the frame being inserted to a stud pin 8 fixed to a sidewall of the panel 1. And, there is an inner shield 9 fixed to one side of the frame by a fixing spring 10 for protecting the electron beams 4, which travel toward the fluorescent film 2 when the cathode ray tube is operative, against an external earth magnetism, and there is reinforcement band 11 wound on an outer circumference of the cathode ray tube (CRT) for preventing burst of the CRT by an external impact during operation of the CRT. There is decorative graphite (not shown) coated on inside and outside surfaces of the funnel 3. There are two, four, and six polar magnets 12 mounted on an outer circumference of a neck portion 3*a* for correcting paths of travel of the electron beams 4 so that the electron beams 4 can hit on desired fluorescent materials, exactly. And, there is a deflection yoke 13 on an outer circumference of the neck portion for deflecting the electron beams in a vertical and a horizontal directions.

Accordingly, when a heater built in the cathode (not shown) is heated, electrons are emitted from the cathode by a heat from the heater and voltage differences between the cathode and adjacent electrodes, and the emitted electron beams 4 are accelerated and converged as the electron beams 4 pass through holes of a plurality of electrodes disposed at fixed intervals vertical to a direction of travel of the electron beams starting from the cathode toward the screen in succession, and travel deflected in a vertical and a horizontal direction by the deflection yoke 13 mounted on the outer circumference of the neck portion. The electron beams traveled thus pass through a hole of the shadow mask 5 mounted adjacent to the fluorescent film 2, and hit on a relevant fluorescent material formed on an inside surface of the panel 1 exactly, thereby reproducing an image.

A form of the image on the screen is dependent on inner and outer forms (curvatures) of the panel 1; as shown in FIG. 2A, if the panel has fixed curvatures on inside and outside surfaces of the panel 1, as shown in FIG. 6A, the image formed by lights emitted from the fluorescent material coated on the inside surface of the panel is changed because the curvature becomes greater as a distance of view becomes farther to cause refraction indices of the light passing through the panel 1 to vary with the inside and the outside curvatures. In a structure of a panel 1 which has fixed inside and outside curvatures, since the image is curved by refraction of the lights depending on the curvature during operation of the cathode ray tube, a prolonged watch of the image accelerates eye fatigue because watching such an image is not convenient. And, the outside curvature of the panel 1 acts as a convex mirror, to reflect a large area external lights in various angles, which deteriorates a picture quality and causes blinding and fatigue of the eye. In order to solve these problems and to provide a flat image, the panel 1 is formed to have a flat outside surface and a curved inside surface as shown in FIG. 2B, or to have flat surfaces both in outside and inside of the panel 1. However, in a case of the panel 1 as shown in FIG. 2B which has a flat outside surface and a curved inside surface, the image can not be flat perfectly because the inside curvature is dependent on various conditions of an inside structure.

As shown in FIGS. 5A~5C, an extent of curve of the image is dependent on a distance of view to the image, i.e., it can be known that the farther the distance, the greater the extent of curve. That is, as shown in FIG. 6C, even though the image is almost planar when the image is seen near to the image, the image is gradually curved as the distance of view becomes the greater.

In the meantime, as shown in FIG. 2C, in the panel 1 with flat outside and inside surfaces, because a view of the image varies with the distance to the image, to be perfectly flat when the distance is adequate as shown in FIG. 6B, and to be concave when the distance is short contrary to above and to be the flatter as the distance becomes the farther, a computer monitor has a problem in that a perfect flat image can not be implemented because the distance of view is short comparatively.

SUMMARY OF THE INVENTION

Accordingly, the present invention is directed to a panel in a cathode ray tube that substantially obviates one or more of the problems due to limitations and disadvantages of the related art.

An object of the present invention is to provide a panel in a cathode ray tube, which can provide a perfect flat image at an appropriate distance of view.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the panel in a CRT having a flat outside and a curved inside surfaces, wherein a condition of $2.48\times10^6(mm^2)\leqq R\times CFT\leqq 4.38\times10^6(mm^2)$ is set for the CRT for use as a TV receiver, where R is a curvature represented by at least one of vertical, horizontal and diagonal curvatures of the inside surface of the panel and CFT is a center thickness of the panel.

In other aspect of the present invention, there is provided panel in a CRT having a flat outside and a curved inside surfaces, wherein a condition of $2.17\times10^5(mm^2)\leqq R\times CFT\leqq 6.93\times10^5(mm^2)$ is set for the CRT for use as a monitor, where R is a curvature represented by at least one of vertical, horizontal and diagonal curvatures of the inside surface of the panel and CFT is a center thickness of the panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 7A:
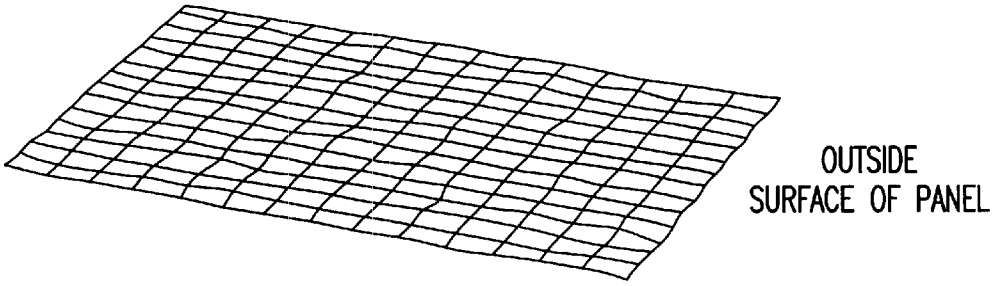
Figure 7B:
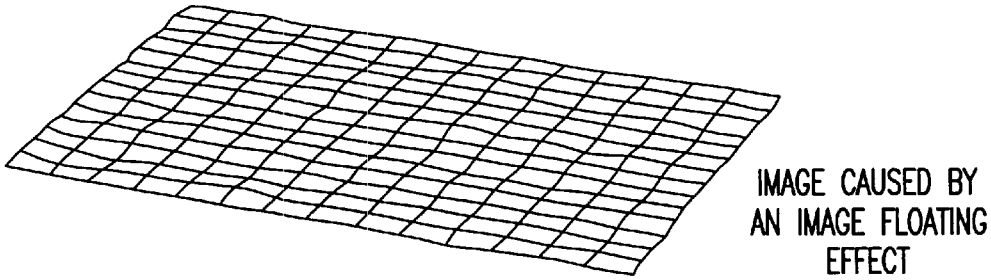
Figure 7C:
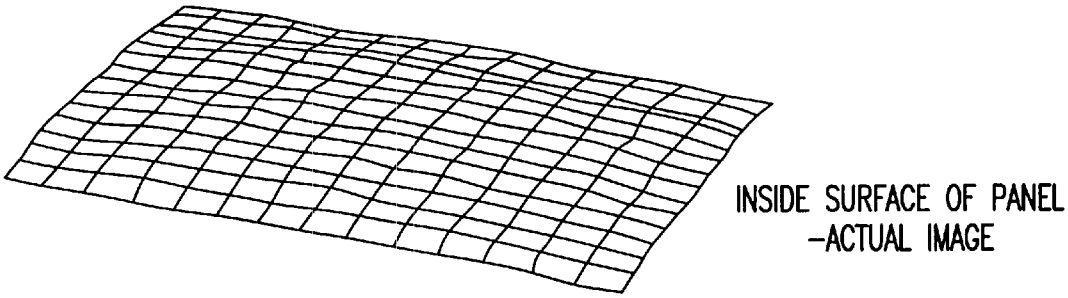

Reference will now be made in detail to the preferred embodiments of the present invention, examples of which are illustrated in the accompanying drawings. FIGS. 7A~7C illustrate images varied with inside and outside curvatures of a panel of the present invention and an image floating effect.

A path of light which reaches to an eye via a medium can be expressed as follows according to Snell's law in a panel 1 of the present invention.

$$n_0 \sin \theta_0 = n_1 \sin \theta_1,$$

Figure 1:
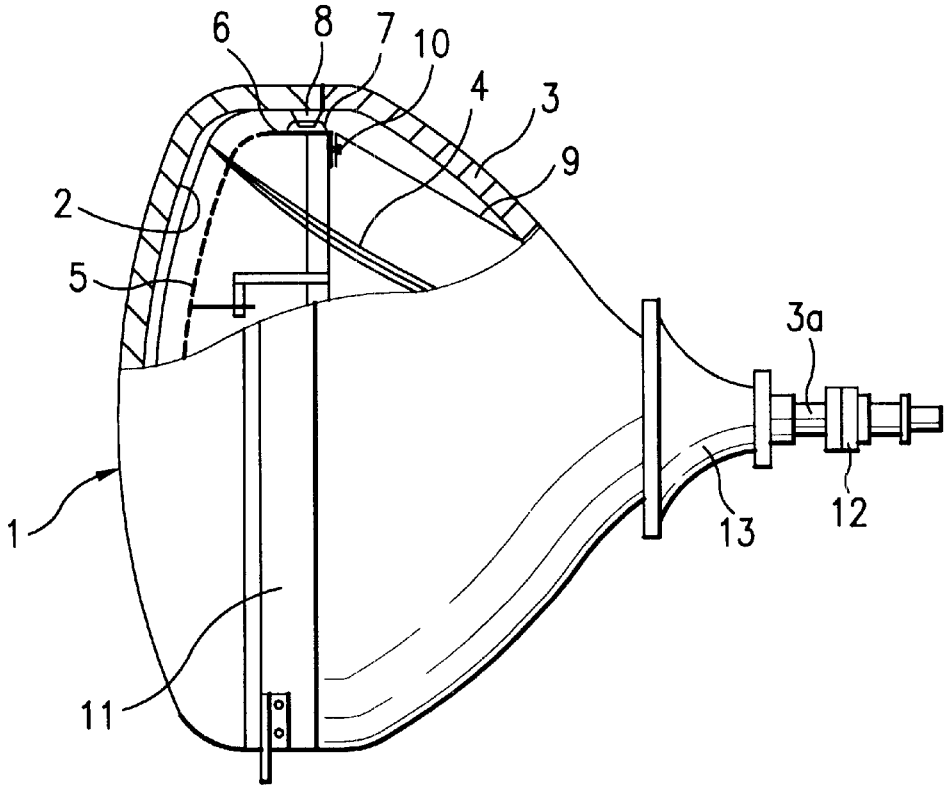
FIG. 1 Related Art
FIG. 1 illustrates a side view showing a related art cathode ray tube with a partial section.
Figure 2A:
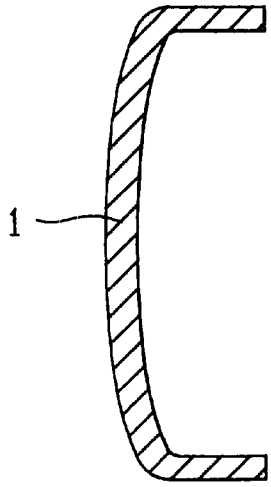
FIG. 2A Related Art
FIGS. 2A~2C illustrate cross sections showing different forms of CRT panels.
Figure 2B:
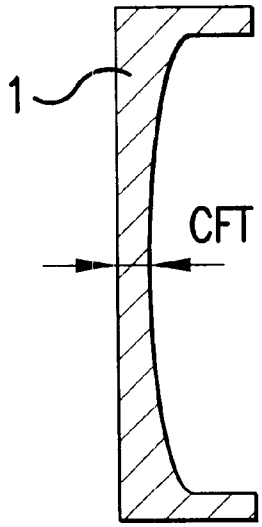
Figure 2C:
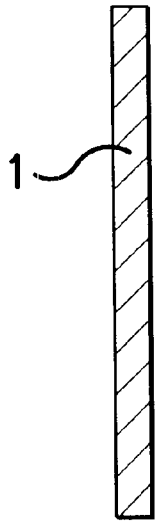
Figure 3:
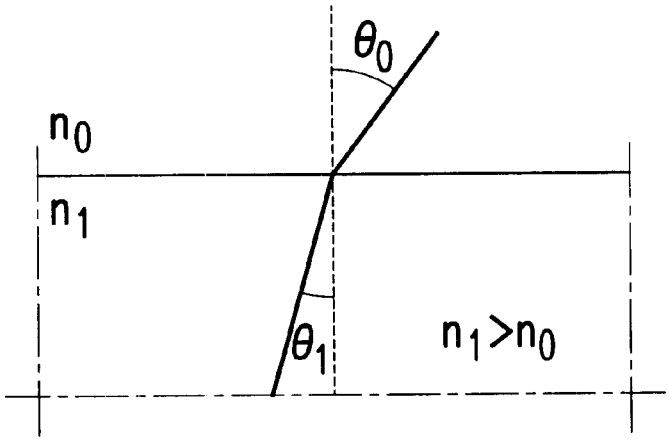
FIGS. 3 explains Snell's law.
Figure 4:
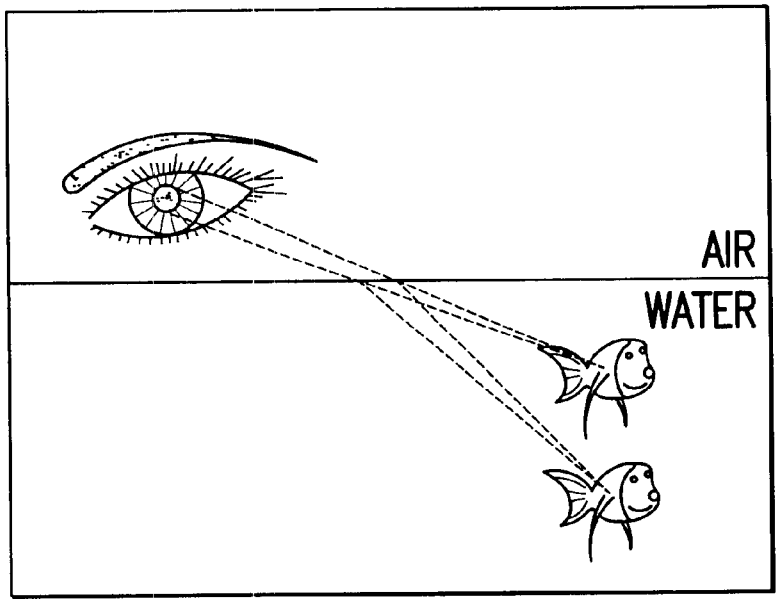
FIG. 4 explains an image floating effect.
Figure 5A:
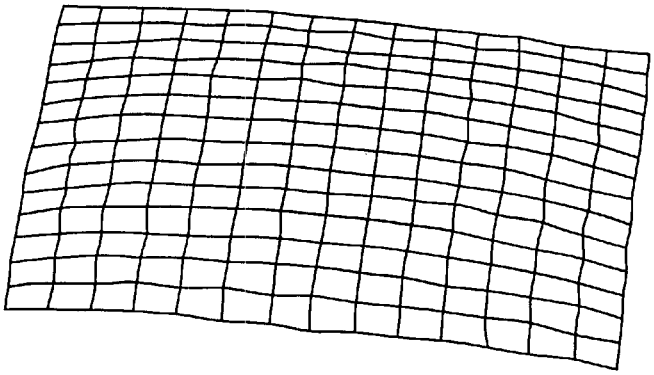
FIGS. 5A~5C illustrate images varied with distances caused by an image floating effect in a CRT.
Figure 5B:
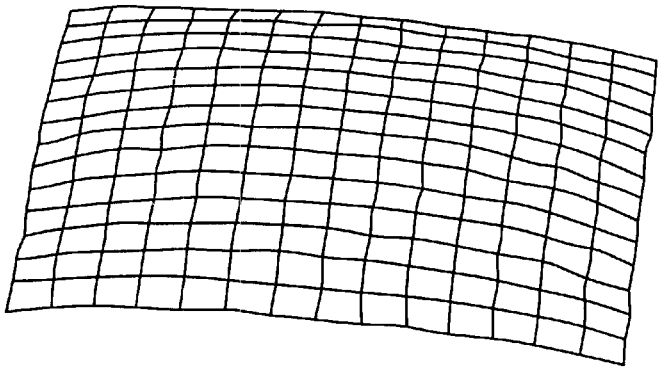
Figure 5C:
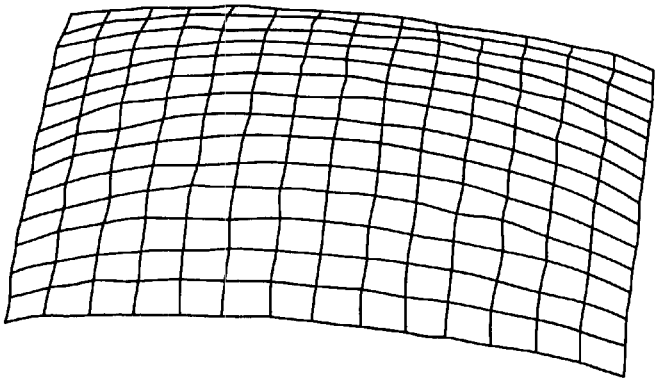

Where, $n_0$ denotes a refractive index of a light in a vacuum, and $\theta_0$ is an incident angle of the light, $n_1$ denotes a refractive index of a light in a medium, which is approx. 1.542 in a case of the panel of glass, and $\theta_1$ is a refracted angle of the light. A phenomenon exhibited as the light is refracted according to Snell's law is called as an image floating effect, which is a phenomenon that an object appears floated than actual position of object. According to the image floating effect, in the case of the panel 1 with a flat outside surface and curved inside surface, since the image displayed to outside of the panel appears larger than the inside curvature when the cathode ray tube is operative, the image appears flatter in fact. And, in the image floating effect, since positions of the floated images differ depending on positions of the eye, the image appears difference as shown in FIGS. 5A~5C depending on distances of view when the panel 1 has a flat outside surface and a curved inside surface the same as the present invention. Though the image shown in FIG. 5A, an image seen from a position distanced 50 cm from an outside surface of the CRT, is almost flat, when the same image is seen from positions distanced 1 m and 3 m from the outside surface of the CRT respectively, the image is seen convex curved as the curvature becomes gradually greater. That is, if the inside surface is curved, the image appears more curved as the distance of view from the outside surface is the greater.

Figure 6A:
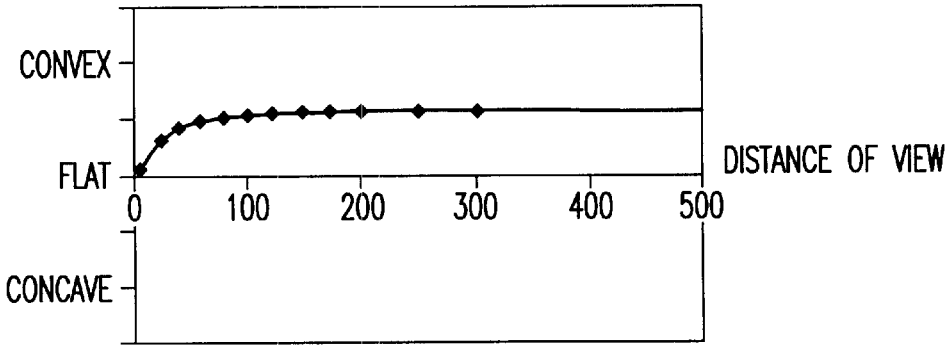
FIGS. 6A~6C illustrate senses of flatness of an image varied with distances in a panel as shown in FIGS. 2A~2C; and, FIGS. 7A~7C illustrate images varied with inside and outside curvatures of a panel of the present invention and an image floating effect.
Figure 6B:
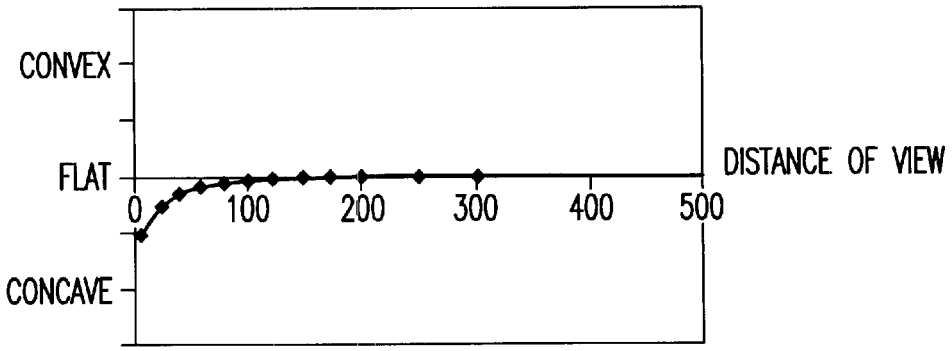
Figure 6C:
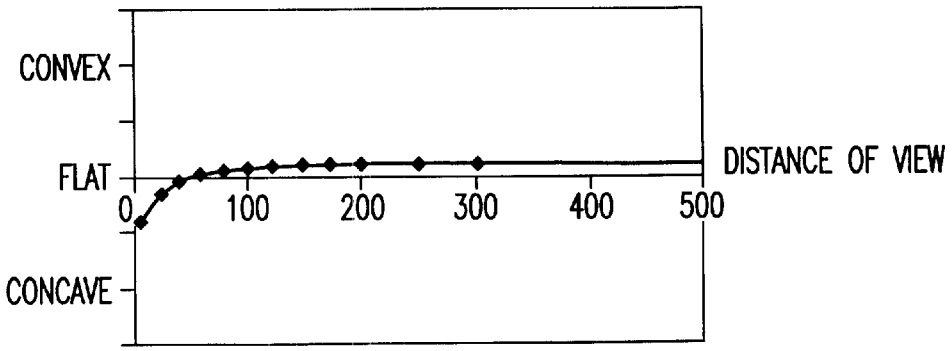

FIGS. 6A~6C illustrate graphs showing curvatures of an image displayed on a screen as distances of view from an outside of the CRT becomes the greater. FIG. 6A illustrates a case of the panel having curved inside and outside surfaces, wherein the image appears convex curved starting from a short distance, which becomes more curved as the distance becomes greater. FIG. 6B illustrates a case of the panel having flat inside and outside surfaces, wherein the image appears concave curved when the image is seen from a short distance, and appears flatter as the distance becomes greater. However, because the distance at which the image is seen flat perfectly is more or less far, the CRT provides a concave image for a CRT for use as a monitor which requires an appropriate distance of view. FIG. 6C illustrates a panel with flat outside and curved inside surfaces, wherein the image appears concave at a short distance, becomes gradually flat as the distance becomes greater, and turns gradually convex. Accordingly, the panel with flat outside and curved inside surfaces can provide a flat image at an appropriate distance of view meeting a distance requirement of the CRT if the inside curvature is adjusted appropriately.

There are CRT for use as a TV receiver and CRT for use as a monitor. The CRT for a TV receiver receives an external signal transmitted from a broadcasting station, and provides watchers with a moving picture. The CRT used currently is a size larger than 20" mostly, of which appropriate distance of view is approx. 1.5~2.0 m. The CRT for use as a monitor has a size below 21" mostly, of which appropriate distance of view is approx. 0.5~0.9 m.

The present invention sets the inside curvature of a panel for implementing a perfect flat image when the outside surface of the panel 1 is flat, taking the appropriate distance of view in the case of CRT for TV receiver to be approx. 1.5~2.0 m and in the case of CRT for monitor to be approx. 0.5~0.9 m. The inside curvature of the panel 1 is very sensitive to change of a thickness of the panel, i.e., as the thickness of the panel becomes the thicker, the inside curvature required for exhibiting the image in perfect flat becomes the smaller. Therefore, according to the present invention, the inside curvature R and a center thickness CFT of a panel 1, which make an image to appear perfect flat, can be expressed as a multiple of the inside curvature R and the center thickness CFT as shown in TABLE 1 below.

TABLE 1

| CRT for TV receiver | | CRT for monitor | |
|---|---|---|---|
| distance | R × CFT($mm^2$) | distance | R × CFT($mm^2$) |
| 1.5 m | $2.48 \times 10^6$ | 0.5 m | $2.17 \times 10^5$ |
| 2.0 m | $4.38 \times 10^6$ | 0.9 m | $6.93 \times 10^5$ |

That is, in the case of CRT for TV receiver, a criteria which can make an image to appear perfect flat can be set to be $2.48\times10^6(mm^2) \leqq R\times CFT \times 4.38\times10^6(mm^2)$, where R is a curvature represented by at least one of vertical, horizontal and diagonal curvatures of the inside surface of the panel 1. And, in the case of CRT for monitor, a criteria which can make an image to appear perfect flat can be set to be $2.17\times10^5(mm^2) \leqq R\times CFT \leqq 6.93\times10^5(mm^2)$, where R is a curvature represented by at least one of vertical, horizontal and diagonal curvatures of the inside surface of the panel 1. Though it is favorable for implementing a flat image if representative curvatures R in the horizontal, vertical and diagonal directions are set to be the above criteria, it is adequate that one or two representative curvatures R in the horizontal, vertical and diagonal directions may be set to be the above criteria considering safety of the CRT and a strength of the shadow mask.

As has been explained, the panel in a cathode ray tube of the present invention can eliminate distortion of an image to implement a perfect flat image by adjusting an inside curvature of the panel in a structure of a panel having flat outside and curved inside surfaces, thereby improving a strength and a quality of the CRT.

It will be apparent to those skilled in the art that various modifications and variations can be made in the panel in a cathode ray tube of the present invention without departing from the spirit or scope of the invention. Thus, it is intended that the present invention cover the modifications and variations of this invention provided they come within the scope of the appended claims and their equivalents.

What is claimed is:

1. A panel in a CRT (cathode ray tube) having a flat outside surface and a curved inside surface, wherein a condition of $2.48\times10^6(mm^2)\leqq R\times CFT\leqq 4.38\times10^6(mm^2)$ is set for the CRT for use as a TV receiver, where R is a curvature represented by at least one of vertical, horizontal and diagonal curvatures of the inside surface of the panel and CFT is a center thickness of the panel.

2. The panel as claimed in claim 1, wherein representative curvatures in vertical, horizontal and diagonal directions are respectively set in the condition.

3. The panel in a CRT (cathode ray tube) having a flat outside surface and a curved inside surface, wherein a condition of $2.17\times10^5(mm^2)\leqq R\times CFT\leqq 6.93\times10^5(mm^2)$ is set for the CRT for use as a monitor, where R is a curvature represented by at least one of vertical, horizontal and diagonal curvatures of the inside surface of the panel and CFT is a center thickness of the panel.

4. The panel as claimed in claim 3, wherein representative curvatures in vertical, horizontal and diagonal directions are respectively set in the condition.

* * * * *